US012703956B2

(12) United States Patent
Yada et al.

(10) Patent No.: US 12,703,956 B2
(45) Date of Patent: Aug. 11, 2026

(54) WORK VEHICLE

(71) Applicant: HITACHI CONSTRUCTION MACHINERY CO., LTD., Tokyo (JP)

(72) Inventors: Hiroaki Yada, Ryuugasaki (JP); Hiroyuki Kizaki, Nagareyama (JP); Shoroku Kawahara, Ushiku (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 244 days.

(21) Appl. No.: 18/687,853

(22) PCT Filed: Dec. 14, 2022

(86) PCT No.: PCT/JP2022/046012

§ 371 (c)(1),
(2) Date: Feb. 29, 2024

(87) PCT Pub. No.: WO2023/127494

PCT Pub. Date: Jul. 6, 2023

(65) Prior Publication Data

US 2024/0401301 A1 Dec. 5, 2024

(30) Foreign Application Priority Data

Dec. 28, 2021 (JP) ..... 2021-213574

(51) Int. Cl.
*E02F 3/34* (2006.01)
*E02F 3/42* (2006.01)
*E02F 9/26* (2006.01)

(52) U.S. Cl.
CPC ..... *E02F 3/3405* (2013.01); *E02F 3/422* (2013.01); *E02F 9/264* (2013.01)

(58) Field of Classification Search
None
See application file for complete search history.

(56) References Cited

U.S. PATENT DOCUMENTS 7,008,169 B1 * 3/2006 Miyanishi ..... E02F 3/38 414/722
8,821,104 B2 * 9/2014 Yasuda ..... E02F 9/0816 414/722

(Continued)

FOREIGN PATENT DOCUMENTS

JP S56-77562 U 6/1981
JP 2011-196070 A 10/2011

(Continued)

OTHER PUBLICATIONS

International Search Report of PCT/JP2022/046012 dated Feb. 28, 2023.

*Primary Examiner* — Michael S Lowe
(74) *Attorney, Agent, or Firm* — MATTINGLY & MALUR, PC

(57) ABSTRACT

The work vehicle includes a frame, a lift arm having a base end section attached to the frame, a work tool attached to the distal end section of the lift arm, a base-end link device attached to the frame and the base end section side of the lift arm, a distal-end link device attached to the work tool and the distal end side of the lift arm, and a work tool cylinder extending from the base-end link device toward the distal-end link device and driving the work tool via the distal-end link device. An angle detection device attached to the lift arm and detecting the angle formed by the lift arm and the distal-end link device is provided. The angle detection device is disposed between the portion of the lift arm to which the distal-end link device is connected and the base end section of the lift arm.

4 Claims, 7 Drawing Sheets

(56) References Cited

U.S. PATENT DOCUMENTS

| | | | | |
|---|---|---|---|---|
| 9,637,888 | B2 * | 5/2017 | Iwamoto | E02F 3/32 |
| 2014/0105715 | A1 | 4/2014 | Tracy et al. | |
| 2014/0119870 | A1 | 5/2014 | Martinez et al. | |

FOREIGN PATENT DOCUMENTS

| | | | |
|---|---|---|---|
| JP | 2017-125353 | A | 7/2017 |
| JP | 2021-095710 | A | 6/2021 |

* cited by examiner

WORK VEHICLE

TECHNICAL FIELD

The present invention relates to a work vehicle that is used for a cargo handling operation of excavating target substances, such as soil and sand and minerals, to load them into a dump truck and the like.

BACKGROUND ART

A work vehicle such as a wheel loader includes a cargo handling device that can drive a front work tool up and down via a link mechanism by driving a hydraulic actuator. For the link mechanism configuring the cargo handling device, there are a Z link mechanism and a parallel link mechanism. In the cargo handling device configured of the Z link mechanism, change occurs in the posture (inclination) of the front work tool with the up-down movement of the front work tool. On the contrary, the cargo handling device configured of the parallel link mechanism has an advantage that change in the posture (inclination) of the front work tool with the up-down movement of the front work tool is less and the operation of moving the front work tool in parallel is easily performed. In addition, to control the posture of the cargo handling device, known is one that detects the angle between the respective link members at a plurality of nodes configuring the link mechanism and calculates the posture of the cargo handling device on the basis of the information of the lengths of the respective link members. For example, Patent Literature 1 discloses, in the wheel loader including the cargo handling device configured of the Z link mechanism, a configuration in which an angle sensor is provided at the turning point on a lift arm that turns according to the extension and contraction of a bucket cylinder.

CITATION LIST

Patent Literature

Patent Literature 1:
Japanese Unexamined Patent Application Publication No. 2011-196070

SUMMARY OF INVENTION

Technical Problem

However, when the angle sensor applied to the above Z link mechanism is applied to the cargo handling device configured of the parallel link mechanism, the turning point on the lift arm that turns according to the extension and contraction of the bucket cylinder is located at the position close to the ground in the posture in which the lift arm is lowered and the lift arm is lower than the horizontal, that is, in the parking posture and the traveling posture in which the bucket is located at the position close to the ground. Therefore, the angle sensor is located at the position close to the ground, and the collision of a scattering stone or submergence by excavation and traveling is likely to be caused with respect to the angle sensor, so that the angle sensor may be broken.

The present invention has been made in view of such the circumstances of the conventional art, and an object of the present invention is to provide a work vehicle capable of protecting an angle sensor on a cargo handling device configured of a parallel link mechanism, against collision from the outside or against submergence.

Solution to Problem

To achieve the above object, a representative work vehicle of the present invention includes a frame, a lift arm having a base end section attached to the frame, a work tool attached to the distal end section of the lift arm, a base-end link device attached to the frame and the base end section side of the lift arm, a distal-end link device attached to the work tool and the distal end section side of the lift arm, and a work tool cylinder extending from the base-end link device toward the distal-end link device and driving the work tool via the distal-end link device. An angle detection device attached to the lift arm and detecting the angle formed by the lift arm and the distal-end link device is provided. The angle detection device is disposed between the portion of the lift arm to which the distal-end link device is connected and the base end section of the lift arm.

Advantageous Effects of Invention

According to the work vehicle of the present invention, the angle sensor can be protected against the collision of a scattering stone or submergence by the excavation work and traveling. Objects, configurations, and effects other than the above will be apparent from the description of the following embodiment.

DESCRIPTION OF EMBODIMENTS

Hereinbelow, as an aspect of a work vehicle according to an embodiment of the present invention, a wheel loader is given as an example, and will be described in detail with reference to FIGS. 1 to 7. It should be noted that in the following description, unless otherwise specified, the front, rear, left, right, up, and down directions are based on the viewpoint of an operator who sits in a cab of the wheel loader, and the posture of a vehicle body and a working device is a straight moving posture, and is based on a posture in which a lift arm is lowered and the bottom section of a bucket is contacted onto the ground.

First, a wheel loader 1 according to the embodiment of the present invention will be described with reference to FIGS. 1 to 3.

Figure 1:
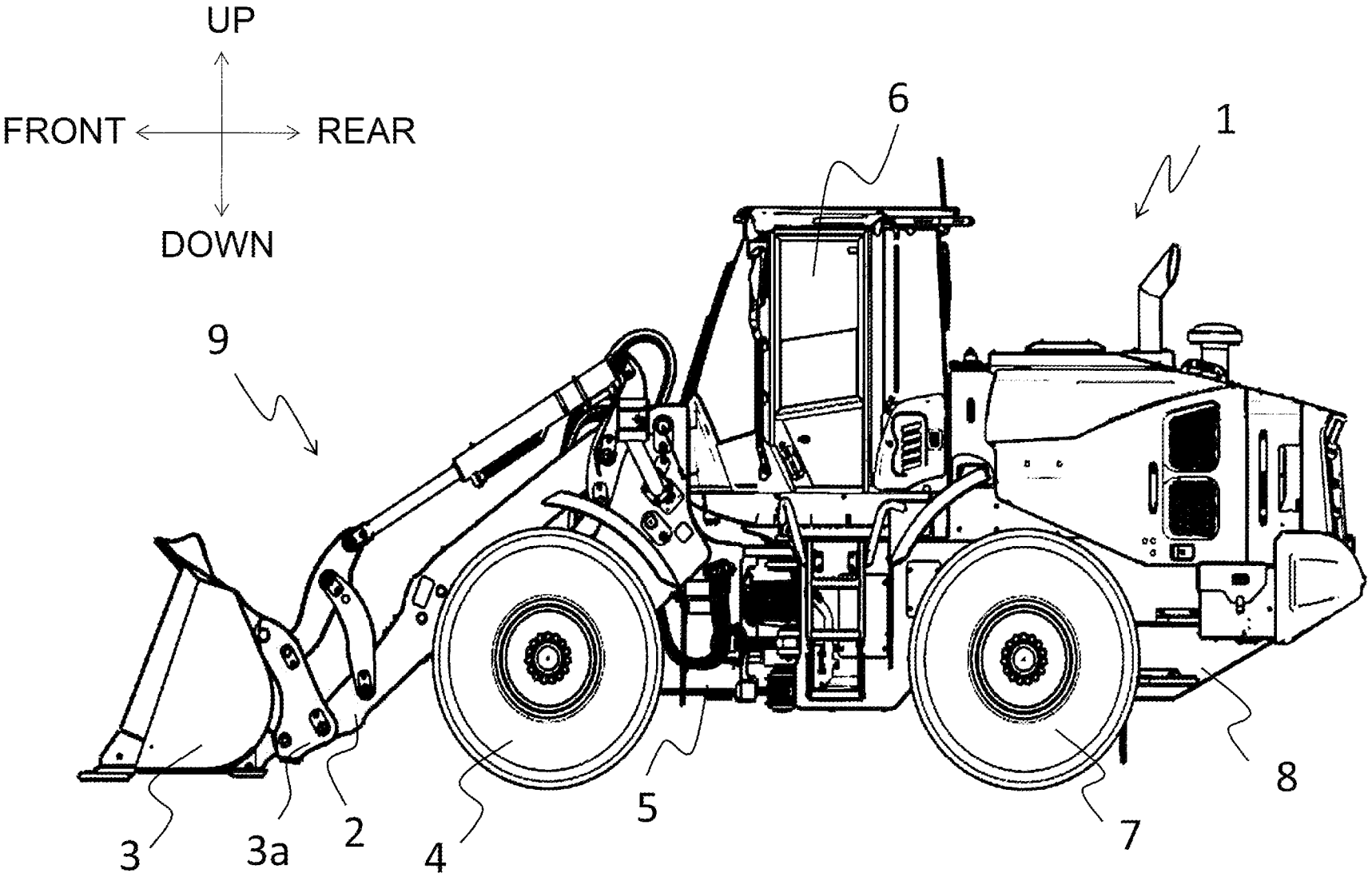
FIG. 1 is a side view of a wheel loader according to an embodiment of the present invention.
Figure 2:
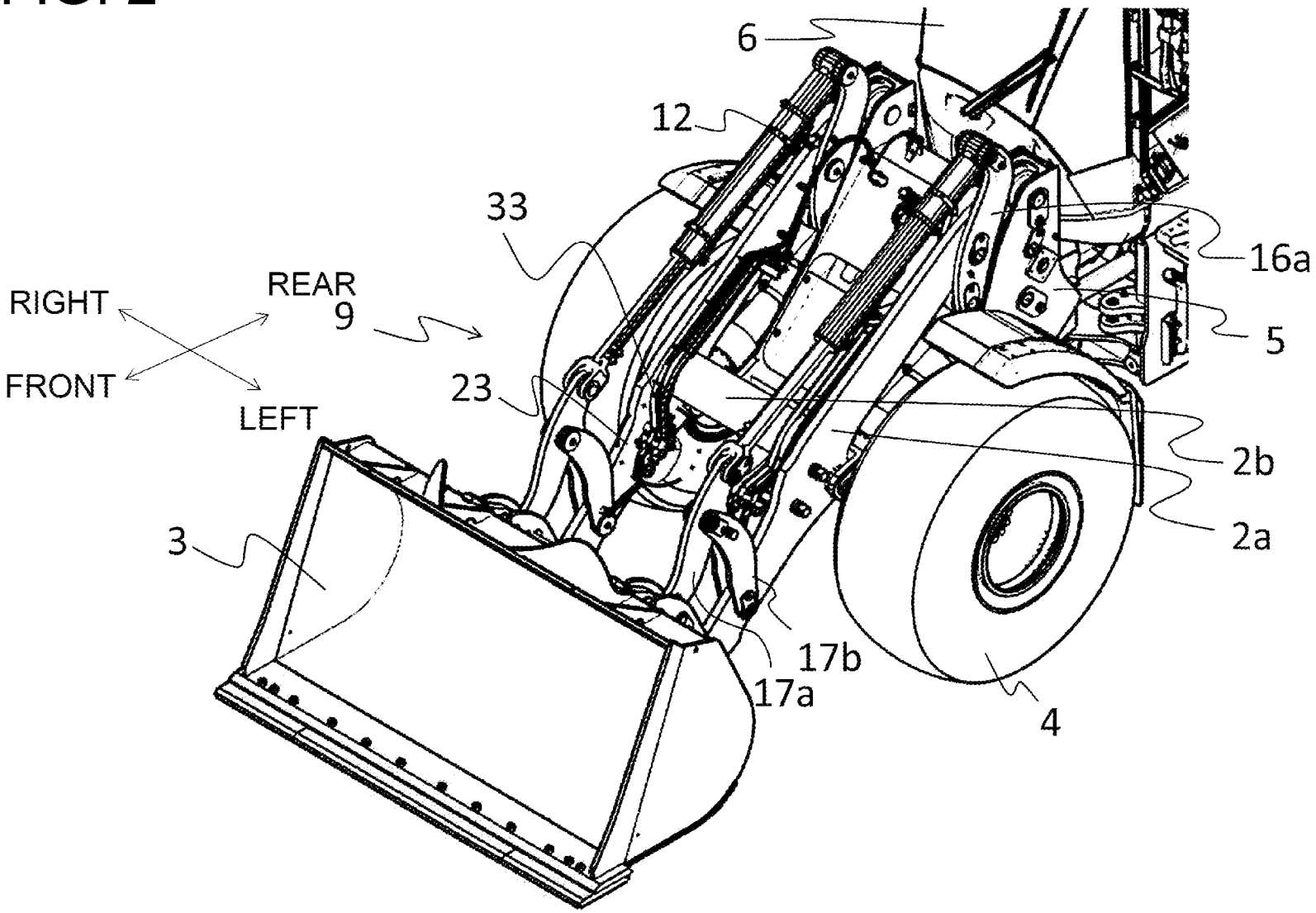
FIG. 2 is a perspective view illustrating a working device configured of a parallel link mechanism.
Figure 3:
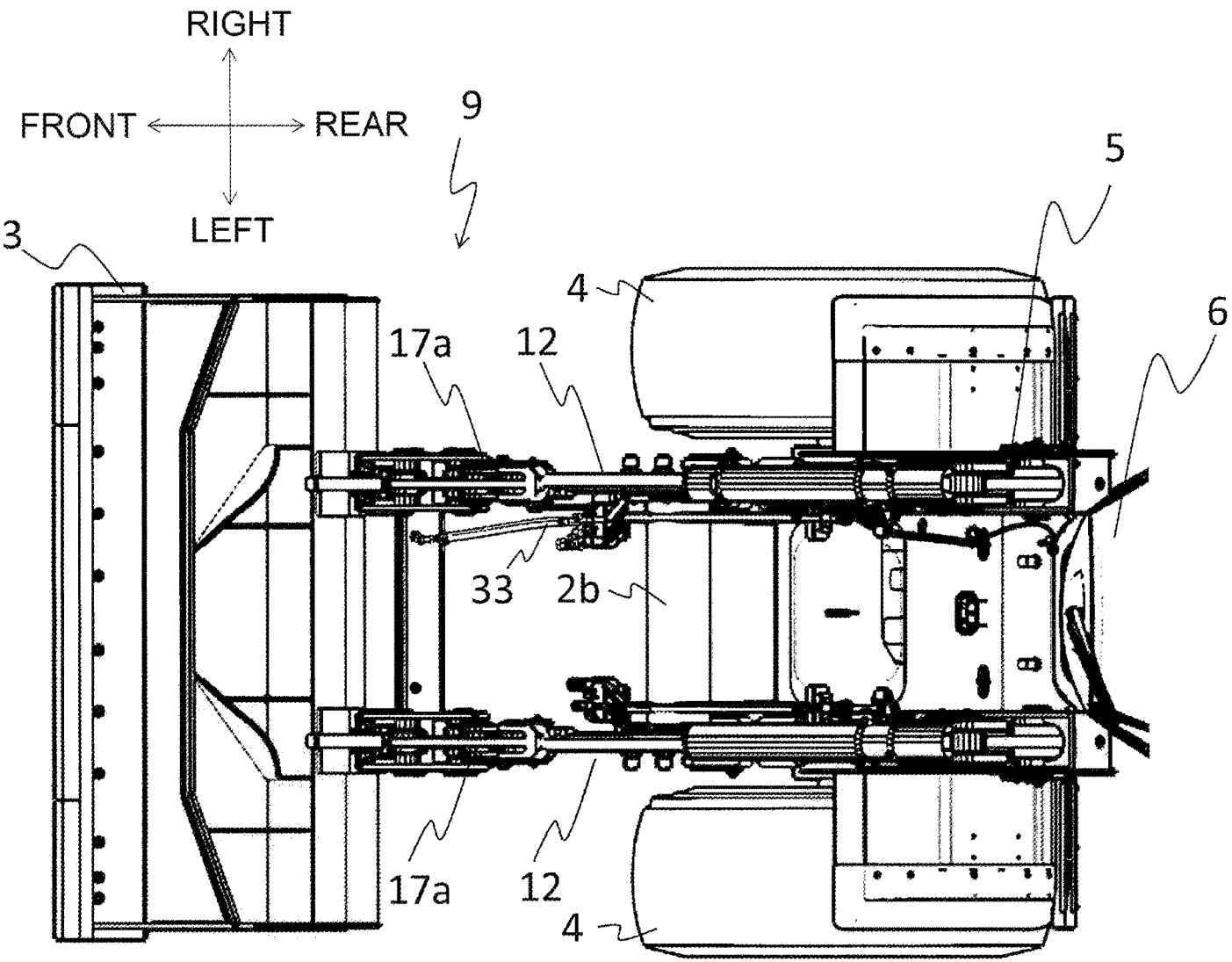
FIG. 3 is a top view illustrating the working device configured of the parallel link mechanism.

FIG. 1 is a side view of the wheel loader according to the embodiment, FIG. 2 is a perspective view illustrating the working device configured of a parallel link mechanism, and FIG. 3 is a top view illustrating the working device configured of the parallel link mechanism.

As illustrated in FIGS. 1, 2, and 3, the vehicle body of the wheel loader 1 is roughly configured of a front frame 5 having a cargo handling device 9 having a lift arm 2 and a bucket 3, a pair of left and right front wheels 4, and the like, and a rear frame 8 having a cab 6, a pair of left and right rear wheels 7, and the like.

The front frame 5 and the rear frame 8 are coupled by a pair of upper and lower center pins to be turnable in the left-right direction. In addition, the front frame 5 and the rear frame 8 are connected by a pair of left and right steering cylinders. These steering cylinders each have a front end connected to the front frame 5, and a rear end connected to the rear frame 8 in a state of being turnable in the left-right direction.

By extending one of the pair of steering cylinders and contractively retracting the other, the front frame 5 is bent in the left-right direction with respect to the rear frame 8 about the center pins. With this, the relative attaching angle of the front frame 5 and the rear frame 8 is changed, and the vehicle body is bent to be steered. That is, the wheel loader 1 is an articulate type work vehicle in which the front frame 5 and the rear frame 8 are bent about the center pins.

The cargo handling device 9 used for the cargo handling work is attached to the front section of the front frame 5. The cargo handling device 9 has the lift arm 2 having a base end section attached to the front frame 5, a pair of left and right lift arm cylinders 10 driving the lift arm 2, the bucket 3 turnably attached to the distal end sections of the lift arm 2, and a pair of left and right bucket cylinders 12 driving the bucket 3. The lift arm cylinder 10 has a base end section turnably attached to the front frame 5 with the pin, and a distal end section turnably attached to the lift arm 2 with the pin. More specifically, a pair of left and right vertical plates 2*a* configuring the lift arm 2, the pair of left and right lift arm cylinders 10, and the pair of left and right bucket cylinders 12 are respectively provided in parallel so as to be spaced apart from each other in the vehicle width direction. The intermediate sections in the longitudinal direction (front-rear direction) of the vertical plates 2*a* are coupled via a lift arm coupling member 2*b*.

Here, the bucket 3 is a work tool for scooping working target substances, such as soil and sand and minerals, and discharging them into a loading destination, such as a dump truck and a hopper. In place of the bucket 3, for example, various work tools, such as a fork and a braker, can be attached to the distal end section of the lift arm 2. More specifically, to facilitate the replacement of the work tool, a quick coupler device 3*a* is provided at the distal end of the lift arm 2, and the work tool is attached to the distal end of the lift arm 2 via the quick coupler device 3*a*. The quick coupler device 3*a* has a coupler cylinder (not illustrated) whose rod is extended and contracted by supplying a hydraulic oil, a pin hole through which the rod of the coupler cylinder can be inserted is formed in the work tool, and the work tool can be attached to and detached from the distal end of the lift arm 2 by extending and contracting the rod of the coupler cylinder. Various hydraulic hoses 33 for supplying the hydraulic oil discharged from a hydraulic pump mounted on the vehicle body to the coupler cylinder and the work tool are routed between the pair of the vertical plates 2*a* of the lift arm, and are fixed to a piping supporting member 31 provided in the intermediate section in the longitudinal direction of the vertical plate 2*a* of the lift arm. It should be noted that since the quick coupler device 3*a* is not an essential configuration, the quick coupler device 3*a* is made to be a portion of the work tool or the bucket, and the present invention will be described below by the configuration in which the quick coupler device 3*a* is omitted.

Next, the detailed configuration of the parallel link mechanism configuring the cargo handling device 9 will be described.

Figure 4:
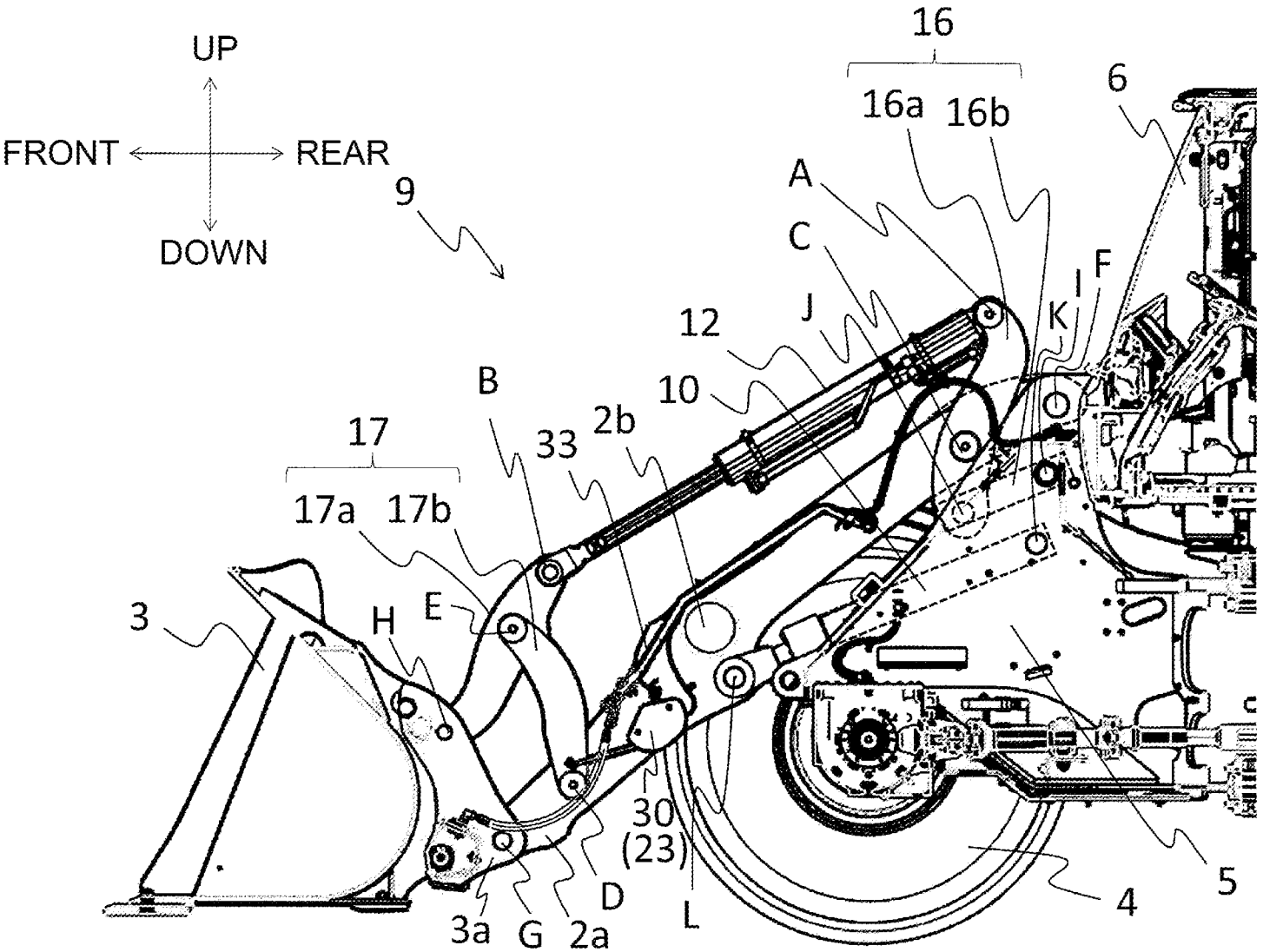
FIG. 4 is a main portion cross-sectional view illustrating the attaching configuration of an angle sensor in the parking posture.

FIG. 4 is a cross-sectional view illustrating the attaching configuration of an angle detection device in the parking posture. As illustrated in FIG. 4, the base end section of the bucket cylinder 12 is attached to the front frame 5 and the vertical plate 2*a* of the lift arm via a base-end link device 16. The distal end section of the bucket cylinder 12 is attached to the bucket 3 and the vertical plate 2*a* of the lift arm via a distal-end link device 17.

Like the bucket cylinders 12, a pair of left and right base-end link devices 16 and a pair of left and right distal-end link devices 17 are respectively provided, and are provided in parallel to be spaced apart from each other in the vehicle width direction.

The lift arm 2 and the bucket cylinder 12 form a set of opposite sides, and the base-end link device 16 and the distal-end link device 17 form another set of opposite sides, thereby forming a substantially square in which points A, B, C, D illustrated in FIG. 4 are vertexes. In addition, the respective coupling portions (the points A, B, C, D) of the lift arm 2, the bucket cylinder 12, the base-end link device 16, and the distal-end link device 17 are turnably coupled with the pins. Therefore, regardless of the operation of the lift arm cylinder 10 and the bucket cylinder 12, the parallelism between the lift arm 2 and the bucket cylinder 12 is held constant.

The base-end link device 16 is configured of a bell crank 16*a* and a frame coupling rod 16*b* described later, and is attached to the front frame 5, the base end section side of the vertical plate 2*a* of the lift arm, and the base end section of the bucket cylinder 12.

The bell crank 16*a* is configured of a set of two plates sandwiching the vertical plate 2*a* of the lift arm from the left and right, the base end section (point J) of the bell crank 16*a* is turnably attached to the distal end section of the frame coupling rod 16*b* with the pin, the intermediate section (point C) in the longitudinal direction of the bell crank 16*a* is turnably attached to the vertical plate 2*a* of the lift arm with the pin, and the distal end section (point A) of the bell crank 16*a* is turnably attached to the base end section of the bucket cylinder 12 with the pin. The portion in which the intermediate section (the point C) in the longitudinal direction of the bell crank 16*a* is attached to the vertical plate 2*a* of the lift arm is positioned between the base end section of the vertical plate 2*a* of the lift arm and the portion in which the distal end section of the lift arm cylinder 10 is pin coupled to the vertical plate 2*a* of the lift arm (between point F and point L), and close to the base end on the vertical plate 2*a* of the lift arm (close to the point F).

The base end section (point I) of the frame coupling rod 16*b* is turnably attached to the front frame 5 with the pin, and the distal end section (the point J) of the frame coupling rod 16*b* is turnably attached to the base end section of the bell crank 16*a* with the pin. Here, the portion (the point I) in which the frame coupling rod 16*b* is attached to the front frame 5 is the portion on the front frame 5 (vertical plate) positioned downward as compared with the portion (the point F) in which the base end section of the vertical plate 2*a* of the lift arm is turnably attached to the front frame 5 and upward as compared with the portion (point K) in which the base end section of the lift arm cylinder 10 is turnably attached to the front frame 5.

The distal-end link device 17 is configured of a bucket coupling rod 17*a* and a guide member 17*b* described later, and is attached to the bucket 3, the distal end section side of the vertical plate 2*a* of the lift arm, and the distal end section of the bucket cylinder 12.

The base end section (point B) of the bucket coupling rod 17*a* is turnably attached to the distal end section of the bucket cylinder 12 with the pin, the intermediate section (point E) in the longitudinal direction of the bucket coupling rod 17*a* is turnably attached to the distal end section of the guide member 17*b* with the pin, and the distal end section (point H) of the bucket coupling rod 17*a* is turnably attached to the bucket 3 with the pin. Here, the portion (the point H) in which the bucket coupling rod 17*a* is attached to the bucket 3 is the portion on the attaching bracket of the bucket 3 positioned upward and separated by a predetermined dimension on the rear surface of the bucket 3 from the portion (point G) of the attaching bracket on the rear surface of the bucket 3 to which the distal end section of the vertical plate 2*a* of the lift arm is turnably attached.

The guide member 17*b* is configured of a set of two plates sandwiching the vertical plate 2*a* of the lift arm from the left and right, the base end section (point D) of the guide member 17*b* is turnably attached to the vertical plate 2*a* of the lift arm with the pin, and the distal end section (the point E) of the guide member 17*b* is turnably attached to the intermediate section in the longitudinal direction of the bucket coupling rod 17*a* with the pin. Here, the portion in which the base end section (the point D) of the guide member 17*b* is attached to the vertical plate 2*a* of the lift arm is the portion on the vertical plate 2*a* of the lift arm positioned between the distal end section of the vertical plate 2*a* of the lift arm and the portion in which the distal end section of the lift arm cylinder 10 is pin coupled to the vertical plate 2*a* of the lift arm (between the point G and the point L).

Next, the detailed attaching configuration of the angle detection device will be described.

Figure 5:
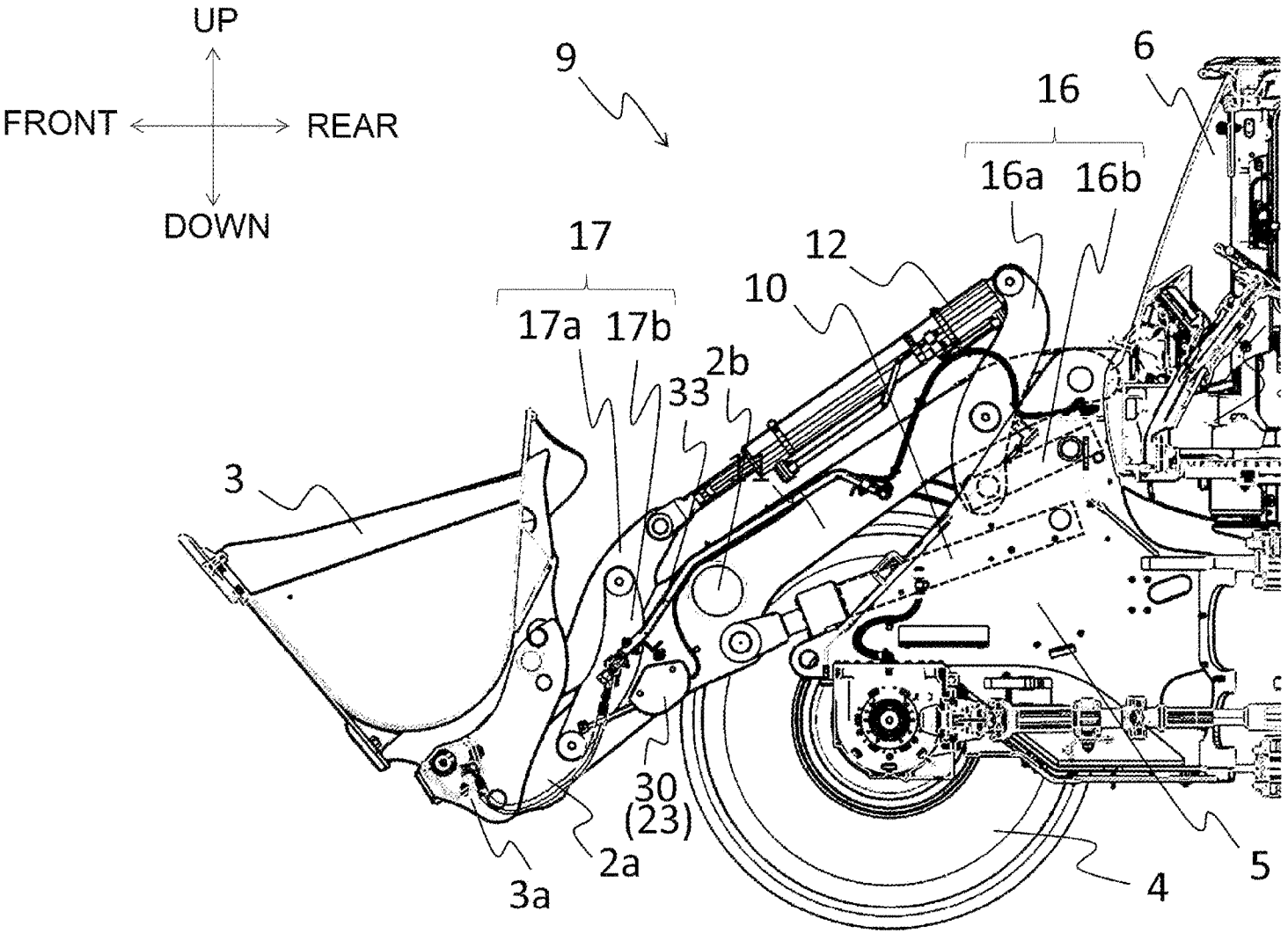
FIG. 5 is a main portion cross-sectional view illustrating the attaching configuration of the angle sensor in the bucket tilt posture.

FIG. 4 is a cross-sectional view illustrating the attaching configuration of the angle detection device in the parking posture, and FIG. 5 is a cross-sectional view illustrating the attaching configuration of the angle detection device in the bucket tilt posture.

As illustrated in FIGS. 4 and 5, the wheel loader includes a first angle detection device 23 detecting the turning angle of the guide member 17*b* in which the base end section of the guide member 17*b* (the connection section (the point D) of the lift arm 2 and the guide member 17*b*) is the turning center. The guide member 17*b* turns in conjunction with the turning of the bucket 3 with the distal end section of the vertical plate 2*a* of the lift arm (the connection section (the point G) of the bucket 3 and the lift arm 2) as the turning center.

In addition, the wheel loader includes a second angle detection device (not illustrated) detecting the turning angle of the lift arm 2 in which the base end section of the lift arm 2 (the connection section (the point F) of the lift arm 2 and the front frame 5) is the turning center. The detection signal of each of the angle detection devices is outputted to a controller (not illustrated) mounted on the vehicle body, and the controller calculates the posture of the cargo handling device 9 on the basis of the detection signal of each of the angle detection devices and the information of the length of the member configuring the cargo handling device 9.

The first angle detection device 23 is provided at the upper position as compared with the portion (the point D) in which the guide member 17*b* and the vertical plate 2*a* of the lift arm are pin coupled and at the lower position as compared with the base end section (the point F) of the vertical plate 2*a* of the lift arm in the posture in which the lift arm 2 is lowered and the lift arm 2 is lower than the horizontal, for example, in the parking posture in which the bottom section of the bucket 3 is contacted onto the ground. More specifically, the first angle detection device 23 is provided at the position higher than the rotation center of the front wheel 4 and the rear wheel 7 in the case of the parking posture in which the lift arm 2 is lowered and the bottom section of the bucket 3 is contacted onto the ground.

In other words, the first angle detection device 23 is provided at the rear position as compared with the portion (the point D) in which the guide member 17*b* and the vertical plate 2*a* of the lift arm are pin coupled and at the front position as compared with the base end section (the point F) of the vertical plate 2*a* of the lift arm.

In addition, the first angle detection device 23 is provided between the pair of left and right vertical plates 2*a* of the lift arm with respect to the vehicle width direction. More specifically, the first angle detection device 23 is provided on the left side surface of the vertical plate 2*a* of the lift arm on the right side forming the pair of left and right vertical plates 2*a* of the lift arm. It should be noted that the position where the first angle detection device 23 is attached to the pair of left and right vertical plates 2*a* of the lift arm is not limited to the left side surface of the vertical plate 2*a* of the lift arm on the right side, and may be on the right side surface of the vertical plate 2*a* of the lift arm on the left side.

Figure 6:
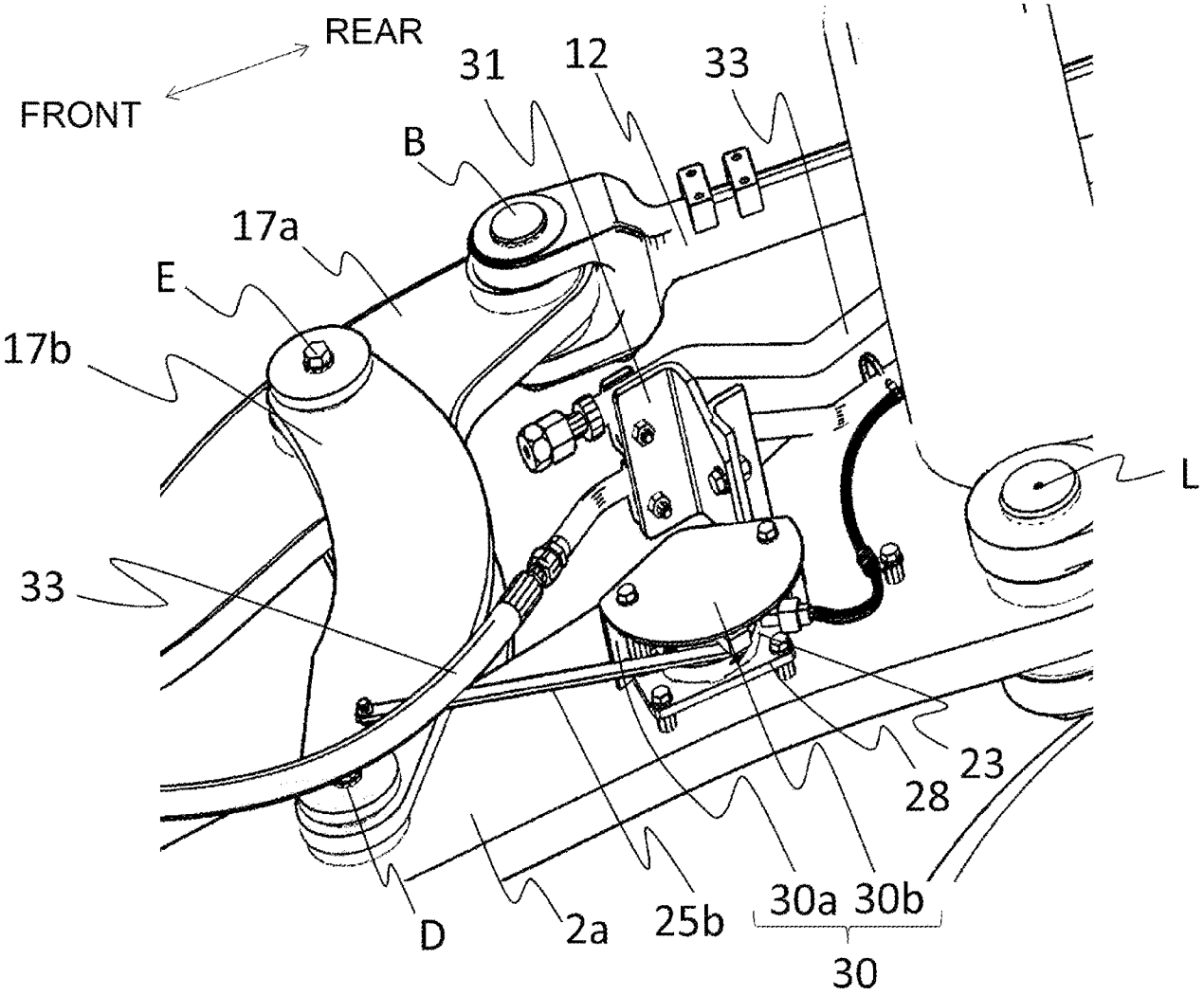
FIG. 6 is a main portion perspective view illustrating the attaching configuration of the angle sensor.
Figure 7:
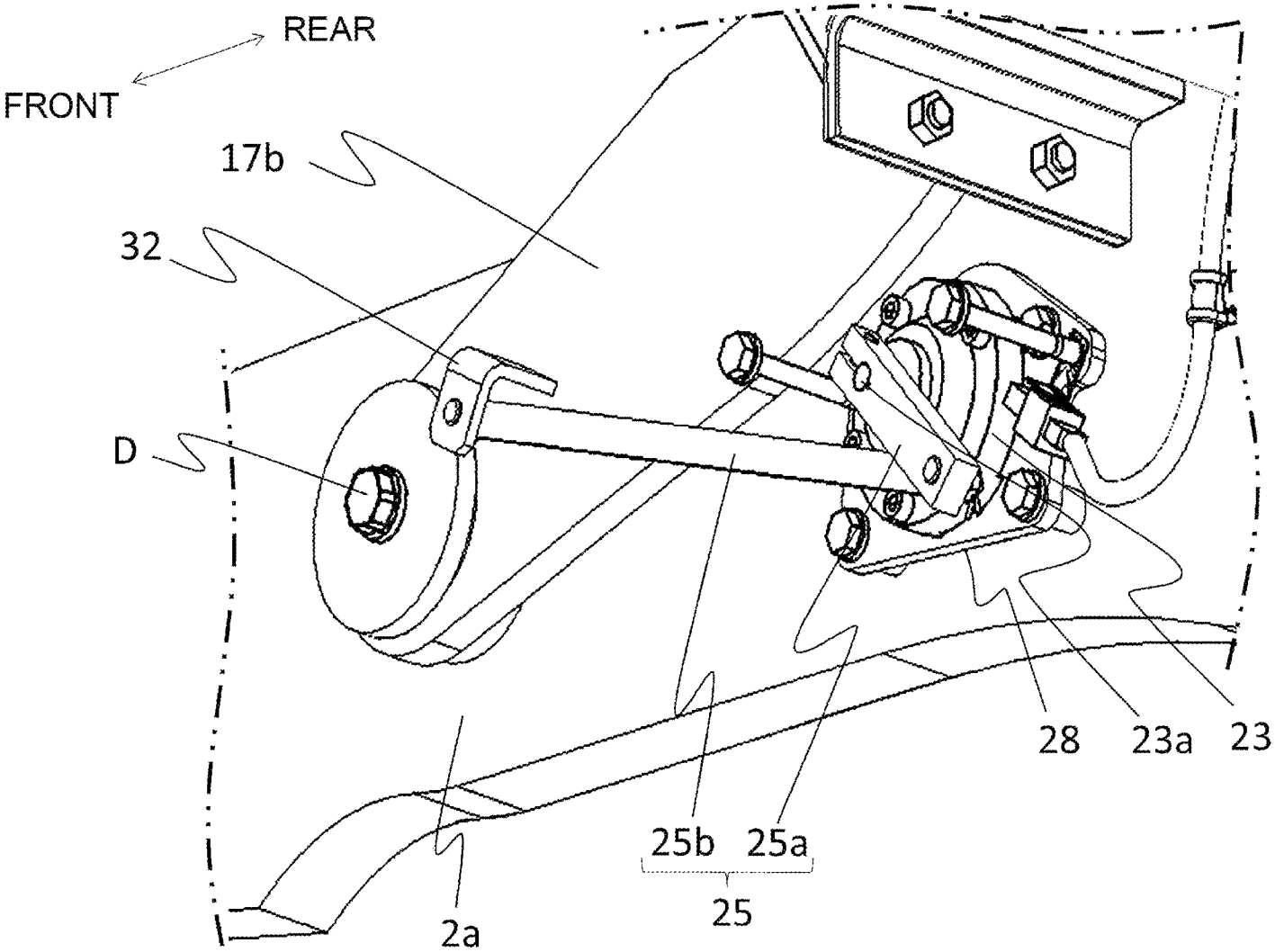
FIG. 7 is a main portion perspective view illustrating a turning angle transmission mechanism.

FIG. 6 is a main portion perspective view illustrating the attaching configuration of the first angle detection device, and FIG. 7 is a perspective view illustrating a turning angle transmission mechanism.

As illustrated in FIGS. 6 and 7, the first angle detection device 23 is installed on the inner side surface of one of the pair of left and right vertical plates 2*a* of the lift arm via an angle sensor attaching bracket 28 fixed to the vertical plate 2*a* of the lift arm.

The first angle detection device 23 and an angle sensor protection cover 30 are bolt fastened to the angle sensor attaching bracket 28.

The first angle detection device 23 is an angle sensor incorporating a potentiometer, and is configured to have a sensor rotation shaft 23*a* protruding to the opposite side of the attaching surface and rotating with the perpendicular direction with respect to the attaching surface as the axis.

The first angle detection device 23 detects the rotation angle of the sensor rotation shaft 23*a*. In addition, the sensor rotation shaft 23*a* rotates in conjunction with the turning of the guide member 17*b* with respect to the vertical plate 2*a* of the lift arm in which the pin (the point D) coupling the vertical plate 2*a* of the lift arm and the guide member 17*b* is the turning center, via a turning angle transmission mechanism 25 described later. That is, the first angle detection device 23 is configured so as to be able to detect the turning angle of the guide member 17*b* in which the base end section of the guide member 17*b* (the connection section (the point D) of the lift arm 2 and the guide member 17*b*) is the turning center.

The turning angle transmission mechanism 25 is configured of a first transmission bar 25*a* fixed to the sensor rotation shaft 23*a* of the first angle detection device 23 and extensively provided downward from the sensor rotation shaft 23*a*, and a second transmission bar 25*b* coupling the guide member 17*b* and the first transmission bar 25*a*. More specifically, the second transmission bar 25*b* is turnably attached to a second transmission bar supporting member 32 provided on the guide member 17*b* with the pin.

The first transmission bar 25*a* is configured of one plate, has one end fixed to the sensor rotation shaft 23*a* of the first angle detection device 23, and the other end provided with a through hole in order for the first transmission bar 25*a* to be turnably pin coupled to the second transmission bar 25*b*.

The second transmission bar 25*b* is configured of one plate, has one end provided with a through hole in order for the second transmission bar 25*b* to be turnably pin coupled to the first transmission bar 25*a*, and the other end provided with a through hole in order for the second transmission bar 25*b* to be turnably pin coupled to the second transmission bar supporting member 32.

The second transmission bar supporting member 32 is configured of one bending plate, and has one end fixed to the guide member 17*b*, and the other end provided with a through hole in order for the second transmission bar supporting member 32 to be turnably pin coupled to the second transmission bar 25*b*.

The first angle detection device 23 is fixed to the vertical plate 2*a* of the lift arm via the angle sensor attaching bracket 28. The angle sensor attaching bracket 28 is provided with a screw hole into which the bolt can be threaded, and is formed so as to be able to fasten the first angle detection device 23 and the angle sensor protection cover 30 by the bolt. The angle sensor protection cover 30 is formed of a ceiling member 30*a* covering the upper portion of the first angle detection device 23, and a side plate member 30*b* covering the surface on the opposite side of the attaching surface of the first angle detection device 23 with respect to the vertical plate 2*a* of the lift arm, that is, the surface of the first angle detection device 23 on the side to which the sensor rotation shaft 23*a* protrudes. On the other hand, the angle sensor protection cover 30 is provided with an opening section on the lower side. In addition, the ceiling member 30*a* of the angle sensor protection cover 30 is provided with a bending section, and is configured not to interfere with the piping supporting member 31, the hydraulic hose 33, and the like disposed around the first angle detection device 23. The side plate member 30*b* of the angle sensor protection cover 30 is configured to be provided with a through hole capable of inserting the bolt therethrough at the position corresponding to the screw hole provided in the angle sensor attaching bracket 28, and to be able to be bolt fastened to the angle sensor attaching bracket 28.

The first angle detection device 23 and the angle sensor protection cover 30 are positioned below the piping supporting member 31 installed on the vertical plate 2*a* of the lift arm and the hydraulic hose 33 supplying the hydraulic oil to the quick coupler tool and the work tool. Further, the vertical plate 2*a* of the lift arm is disposed adjacent to one side of the turning angle transmission mechanism 25, and the hydraulic hose 33 is disposed adjacent to the other side of the turning angle transmission mechanism 25.

The operation of the wheel loader according to the above embodiment will be described.

The lift arm 2 is driven by supplying the hydraulic oil to the lift arm cylinder 10 to extend and contract the rod. Specifically, the lift arm 2 is turned in the up direction with respect to the front frame 5 by extending the rod of the lift arm cylinder 10, and is turned in the down direction with respect to the front frame 5 by contracting the rod.

The bucket 3 is driven by supplying the hydraulic oil to the bucket cylinder 12 to extend and contract the rod. Specifically, the bucket 3 is turned (tilted) in the up direction with respect to the lift arm 2 by contracting the rod of the bucket cylinder 12, and is turned (dumped) in the down direction with respect to the lift arm 2 by extending the rod of the bucket cylinder 12. That is, the bucket 3 scoops the working target substances by the tilt operation, and discharges the scooped working target substances (load) by the dumping operation.

When the bucket cylinder 12 is extended to dump the bucket 3, the guide member 17*b* is also turned forward in conjunction with the turning of the bucket 3 with the base end (the point D) of the guide member 17*b* as the turning center, and the second transmission bar 25*b* turnably attached to the second transmission bar supporting member 32 is moved forward with the turning of the guide member 17*b*. Further, with the movement of the second transmission bar 25*b*, the first transmission bar 25*a* is turned forward together with the sensor rotation shaft 23*a* about the sensor rotation shaft 23*a*. Then, the rotation amount of the sensor rotation shaft 23*a* is detected by the first angle detection device 23.

In addition, when the bucket cylinder 12 is contractively retracted to tilt the bucket 3, the guide member 17*b* is also turned rearward with respect to the lift arm 2 in conjunction with the turning of the bucket 3, and the second transmission bar 25*b* turnably attached to the second transmission bar supporting member 32 is moved rearward with the turning of the guide member 17*b*. Further, with the movement of the second transmission bar 25*b*, the first transmission bar 25*a* is turned rearward about the sensor rotation shaft 23*a*. Then, the rotation amount of the sensor rotation shaft 23*a* is detected by the first angle detection device 23.

The wheel loader 1 according to the embodiment configured in this way has the position relationship in which the first angle detection device 23 is provided at the position higher than the portion (the point D) in which the vertical plate 2*a* of the lift arm and the guide member 17*b* are pin coupled in the case of the posture in which the lift arm 2 is lowered and the lift arm 2 is lower than the horizontal, in other words, in the case of the posture in which the distal end section (the bucket 3) of the lift arm 2 is lower than the base end section (the point F) of the lift arm 2. Therefore, also in the parking posture and the traveling posture in which the bucket 3 is located at the position close to the ground, the first angle detection device 23 can maintain the predetermined height, and can reduce the possibility of the collision of a scattering stone and submergence with respect to the first angle detection device 23.

Further, the attaching surface of the first angle detection device 23 is covered by the lift arm, the surface on the opposite side of the attaching surface of the first angle detection device 23 (the surface on the side to which the turning angle transmission mechanism 25 is attached) and the upper side of the first angle detection device 23 are covered by the angle sensor protection cover 30, and the lower side of the first angle detection device 23 in which the first transmission bar 25*a* rotating with the perpendicular direction with respect to the attaching surface as the axis is extensively provided is opened. Therefore, even when the excavation target substances in the bucket 3 are dropped from the bucket 3, the dropped excavation target substances collide with the vertical plate 2*a* of the lift arm and the angle sensor protection cover 30 before colliding with the first angle detection device 23, so that the load of the collision with respect to the first angle detection device 23 can be reduced, the turning of the first transmission bar with the turning of the bucket 3 is not inhibited, and water, soil and sand, and the like can be prevented from being accumulated in the inside of the angle sensor protection cover 30. With this, the possibility of the breakage of the first angle detection device 23 can be reduced.

Further, the first angle detection device 23 has the position relationship in which the first angle detection device 23 is provided between the pair of left and right vertical plates 2*a* of the lift arm in the vehicle width direction and below the piping supporting member 31 and the hydraulic hose 33. Therefore, for example, even when the excavation target substances in the bucket 3 are dropped from the bucket 3, the dropped excavation target substances collide with the vertical plate 2*a* of the lift arm, the piping supporting member 31, and the hydraulic hose 33 before colliding with the first angle detection device 23, so that the load of the collision with respect to the first angle detection device 23 can be reduced. With this, the possibility of the breakage of the first angle detection device 23 can be reduced.

Further, the hydraulic hose 33 is disposed adjacent to one of both side surfaces of the turning angle transmission mechanism 25, and the vertical plate 2*a* of the lift arm is disposed adjacent to the other side surface of the turning angle transmission mechanism 25. Therefore, for example, even when there is a scattering stone by traveling, the scattering stone collides with the hydraulic hose 33 before colliding with the turning angle transmission mechanism 25, so that the load of the collision with respect to the turning angle transmission mechanism 25 can be reduced.

Modification Examples

In the above embodiment, the case where the first angle detection device 23 is the angle sensor incorporating the potentiometer is illustrated, but the present invention is not limited to this, and a distance measuring sensor that measures the distance from a reflection member to a sensor in non-contact manner may be used. For example, the distance measuring sensor is a millimeter wave radar device, the distance measuring sensor may be attached to the vertical plate 2*a* of the lift arm, the reflection member may be attached at the position on the guide member 17*b* capable of reflecting the millimeter wave radar generated by the distance measuring sensor, and the distance from the reflection member to the sensor changed with the turning of the bucket 3 may be detected to calculate the posture of the cargo handling device 9. In this case, the turning angle transmission mechanism 25 and the second transmission bar supporting member 32 are not required.

It should be noted that the present invention is not limited to the above embodiment. The work tool is not limited to the bucket 3, and for example, a fork may be attached. The part fixed to the piping supporting member 31 positioned above the first angle detection device 23 is not limited to the hydraulic hose 33, and may be, for example, an electric wiring. The attaching position of the first angle detection device 23 is not limited to the position higher than the rotation center of the front wheel 4 and the rear wheel 7 in the case of the parking posture in which the lift arm 2 is lowered and the bottom section of the bucket 3 is contacted onto the ground, and for example, may be the position higher than the bottom sections of the front frame 5 and the rear frame 8.

In addition, the above embodiment is the illustration for describing the present invention, and is not intended to limit the scope of the present invention only to those embodiments. Those skilled in the art can embody the present invention in other various aspects without departing from the purport of the present invention.

REFERENCE SIGNS LIST

1: wheel loader
2: lift arm
2*a*: vertical plate
2*b*: lift arm coupling member
3: bucket (work tool)
3*a*: quick coupler device
4: front wheel
5: front frame
6: cab
7: rear wheel
8: rear frame
9: cargo handling device
10: lift arm cylinder
12: bucket cylinder (work tool cylinder)
16: base-end link device
16*a*: bell crank
16*b*: frame coupling rod
17: distal-end link device
17*a*: bucket coupling rod
17*b*: guide member
23: first angle detection device
23*a*: sensor rotation shaft (rotation shaft)
25: turning angle transmission mechanism
25*a*: first transmission bar
25*b*: second transmission bar
28: angle sensor attaching bracket
30: angle sensor cover (cover)
31: piping supporting member
32: second transmission bar supporting member
33: hydraulic hose

The invention claimed is:

1. A work vehicle comprising:

a frame;

a lift arm having a base end section attached to the frame;

a work tool attached to a distal end section of the lift arm;

a base-end link device attached to the frame and the base end section side of the lift arm;

a distal-end link device attached to the work tool and the distal end section side of the lift arm;

a work tool cylinder extending from the base-end link device toward the distal-end link device and driving the work tool via the distal-end link device;

an angle detection device attached to the lift arm and detecting an angle formed by the lift arm and the distal-end link device;

a turning angle transmission mechanism coupling the distal-end link device and the angle detection device; and a cover covering an upper side of the angle detection device and covering a surface of the angle detection device on which a rotation shaft is provided in a case of a posture in which the distal end section of the lift arm is lower than the base end section of the lift arm, wherein:

the angle detection device is disposed between a portion of the lift arm to which the distal-end link device is connected and the base end section of the lift arm, the rotation shaft is fixed to the turning angle transmission mechanism, the base-end link device has:

a bell crank connecting the base end section of the work tool cylinder and the lift arm, and a frame coupling rod connecting the bell crank and the frame, the distal-end link device has:

a work tool coupling rod connecting the distal end section of the work tool cylinder and the work tool, and a guide member connecting the work tool coupling rod and the lift arm, the turning angle transmission mechanism has:

a first transmission bar having a base end section fixed to the rotation shaft of the angle detection device, and a second transmission bar having a base end section turnably coupled to the distal end section of the first transmission bar and a distal end section turnably coupled to the guide member, the first transmission bar is extensively provided downward from the rotation shaft of the angle detection device in the case of the posture in which the distal end section of the lift arm is lower than the base end section of the lift arm, the cover is provided with an opening section, and the lower side of the angle detection device in which the first transmission bar is extensively provided is opened through the opening section.

2. The work vehicle according to claim 1, further comprising a lift arm cylinder having a base end section attached to the frame and a distal end section attached to the lift arm and driving the lift arm, wherein the angle detection device is disposed between a portion of the lift arm to which the distal-end link device is connected and a portion of the lift arm to which the distal end section of the lift arm cylinder is connected.

3. The work vehicle according to claim 1, further comprising:

a piping connected to the work tool; and a piping supporting member for fixing the piping to the lift arm, wherein the lift arm is configured of a pair of vertical plates opposite to each other to be spaced apart from each other in a vehicle width direction, the angle detection device is disposed between the pair of vertical plates of the lift arm, and the piping supporting member is disposed above the angle detection device and between the pair of vertical plates of the lift arm in the case of the posture in which the distal end sections of the lift arm are lower than the base end sections of the lift arm.

4. The work vehicle according to claim 3, wherein the lift arm is disposed adjacent to one side of the turning angle transmission mechanism, and the piping is disposed adjacent to the other side of the turning angle transmission mechanism.

* * * * *